US005095667A

United States Patent [19]

Ryan et al.

[11] Patent Number: 5,095,667

[45] Date of Patent: Mar. 17, 1992

[54] TELESCOPIC MANHOLE AND STORM DRAIN INSTALLATION

[76] Inventors: Chester Ryan, 200 Charles Bancroft Hwy., Litchfield, N.H. 03031; John Morina, 155 Becker St., Manchester, N.H. 03102

[21] Appl. No.: 611,849

[22] Filed: Nov. 13, 1990

Related U.S. Application Data

[63] Continuation-in-part of Ser. No. 489,511, Mar. 7, 1990, abandoned.

[51] Int. Cl.[5] ..... E02D 29/14

[52] U.S. Cl. ..... 52/20; 52/127.5; 285/42; 404/26

[58] Field of Search ..... 52/20, 220, 221, 127.5, 52/127.7, DIG. 1; 404/26; 210/163, 164; 285/32, 39, 42, 58

[56] References Cited

U.S. PATENT DOCUMENTS

| | | | |
|---|---|---|---|
| 645,437 | 3/1900 | Reardon | 285/39 |
| 1,828,601 | 10/1931 | Frye | 285/42 X |
| 1,945,707 | 2/1934 | Sharp | 52/105 X |
| 1,991,130 | 2/1935 | Warren | 285/42 X |
| 2,626,674 | 1/1953 | Boosey | 285/42 X |
| 3,331,295 | 7/1967 | Sorrell | 404/26 |
| 3,629,981 | 12/1971 | McCaffery | 52/20 X |
| 3,769,768 | 11/1973 | Bertrand | 52/127.5 X |
| 3,967,836 | 7/1976 | Izzi, Sr. | 285/58 X |
| 3,974,599 | 8/1976 | Grosh | 52/20 |
| 4,075,796 | 2/1978 | Cuozzo | 52/20 |
| 4,325,405 | 4/1982 | Christo | 52/20 X |
| 4,337,005 | 6/1982 | LeBaron | 52/20 X |
| 4,597,692 | 7/1986 | Gruenwald | 52/20 X |
| 4,662,777 | 5/1987 | Newton | 52/20 X |
| 4,737,220 | 4/1988 | Ditcher et al. | 52/20 X |
| 4,969,771 | 11/1990 | Bowman | 52/20 X |

*Primary Examiner*—Gary L. Smith
*Assistant Examiner*—Suzanne L. Ding
*Attorney, Agent, or Firm*—Richard C. Litman

[57] ABSTRACT

A telescopic manhole or storm drain installation includes a riser assembly provided with an upper section and adjacent lower section the former of which comprises a side wall defining an inverted frustoconical configuration while the latter provides a vertically disposed member having external threads cooperating with a stationary threaded collar. To prepare for resurfacing of a roadway or the like, no excavation about the riser is required prior to its elevation by use of a tool which engages mating receptors located within the interior of the riser. Rotation of the tool rotates the riser assembly within the threads of the collar until the new, elevated plane is achieved. The effort required to displace the riser is minimial due to the movement of its outer surface away from any grouting or roadway base previously abutting the riser. Risers with non-ciruclar upper sections and lids are accommodated by forming the riser of separate upper and lower sections having a sliding joint structure therebetween. Synthetic polymeric materials are proposed for both the risers and lids having a somewhat similar external configuration but employing lids provided with a body of substantial height and formed with a dome-shaped bottom surface such that vertical compressive forces are transmitted radially thereby and conveyed to the surrounding riser side wall.

13 Claims, 3 Drawing Sheets

TELESCOPIC MANHOLE AND STORM DRAIN INSTALLATION

CROSS-REFERENCE TO RELATED APPLICATION

An application, now abandoned, containing similar subject matter was filed Dec. 31, 1975 and assigned Ser. No. 05/645,922. This application is a continuation-in-Part application of our earlier application, Ser. No. 07/489,511 filed on Mar. 7, 1990, and now abandoned.

BACKGROUND OF THE INVENTION

1. Field of the Invention

The present invention relates generally to manholes and storm drains and more particularly, to an improved manhole and storm drain assembly enabling ready vertical adjustment.

The common procedure practiced in the preparation of roadway access devices for resurfacing beings with removal of sufficient amount of the road composition surrounding the installed riser member. This necessitates the use of a jackhammer along with its compressor apparatus and entails a very time consuming operation as the entire periphery of the riser must be cleared of contact with road material and many risers present a height of 6 or more inches. The foregoing maneuver is required either when replacing the existing riser with a higher model or, before installing adaptor means or manipulating adjustment means to permit elevation of the same riser. After provision is made to modify the plane of the riser and its associated lid or cover, the readjusted assembly is grouted or otherwise sealed in order to fix it in position and to replace road material that had to be removed. It is not uncommon for the repositioning of a large drain or manhole assembly to require up to three men plus their heavy equipment and three hours' time before the road is ready to be resurfaced.

In view of the labor and time now required to ready existing manholes and storm drains for a resurfacing job, the public is often subjected to at least protracted inconvenience and frequently, less than safe driving conditions. This is evident when one considers that the time required to reposition the manholes and storm drains throughout a repaving job of several miles can very well result in many of the repositioned risers remaining in an exposed elevated condition for some time before repaving commences.

What is desirable in the adjustment of a riser is a minimal amount of necessary equipment or force and time. Another desirable feature is to completely eliminate the excavation that has to be done in order to clear the riser from the surrounding pavement so that it can be repositioned. Thus, a combination of these features can save many valuable manhours and expense in the resurfacing of roads, sidewalks and the like.

2. Description of the Prior Art

Asphalt and tar roads are periodically resurfaced every 5 to 7 years. This is due to the wearing away of the surface by the constant passing of traffic and this resurfacing of a road usually raises its height by about 2 inches. Manholes and storm drains which are disposed within the area of a road surface initially have to be raised before the road is resurfaced in order to keep their top openings and supported covers level with the road after it is resurfaced.

Numerous prior art devices have sought to address this issue of adjusting the manhole cover height. U.S. Pat. No. 4,325,405 issued to Christo discloses a telescopic riser used with gas and water mains that are placed in sidewalks. The device uses concentric tubes and screw threads to adjust the height of the riser. This device though does not allow for quick clearance of the surrounding sidewalk surface area. The immediate area must be excavated to clear away enough area for the riser to lift. This excavating can take quite a long time and if there are a number of such risers in place in the area to be resurfaced this adds considerable time to the overall job.

The vertical adjustment of manhole assemblies by the of various ring spacers is taught in U.S. Pat. No. 4,337,005 issued to LeBaron but wherein hoist means must be used to lift the device to allow snap ring(s) to move into position beneath a riser member. Obviously, precise vertical adjustment will not be possible and if the riser ring is lifted too far, an additional snap ring could snap into position beneath the riser ring and nothing short of a major excavation would be necessary to reinstall the entire assembly at a lower position.

Another telescopic manhole assembly is shown in U.S. Pat. No. 4,075,796 issued to Cuozzo and wherein vertical adjustment of a riser is achieved by rotation of the riser within the confines of its sole support comprising a threaded flange. Since the minimum wheel load requirements for a manhole cover and assembly is 16,000 pounds, his flange and threads are formed in a specific manner intended to resist such a load factor, a vast departure from the present invention wherein the weight of the riser as well as loads applied thereto are not transmitted to a threaded member but rather, to a conical riser surface supported by surrounding fixed material.

U.S. Pat. No. 3,390,224 issued to Wyatt also discloses a similar device that utilizes telescopic concentric tubes and mating screw threads to adjust the height. Again there is no clearance between the riser and the paved surface. Excavation must first be done to allow the riser to be lifted up and out. Another problem with this particular device is that it is merely a light-weight shell, incapable of standing up to the pressures that would be exerted by constant traffic.

The use of synthetic compositions to produce an underground enclosure as used in utility installations will be found in U.S. Pat. No. 3,974,599 issued to Grosh and which illustrates a main body member having a vertical wall. An adjustable cap device is provided with a likewise vertical skirt that surrounds the main body member in a spaced-apart relationship.

U.S. Pat. Nos. 3,629,981 and 4,075,796, issued to McCaffrey and Cuozzo respectively, provide manhole risers that have a vertically adjustable portion placed within an outer tube. Excavation would not be as necessary with these devices, but there is quite a bit of frictional force involved in raising these risers due to the substantial extent of the vertical contacting surfaces. Most likely the riser would have to be raised by a machine. In the Cuozzo patent the threads are merely left in a cast state, not further refined by machining. This would give a very high frictional force resisting any attempts at turning the riser.

U.S. Pat. No. 1,828,601 and 2,626,674 issued to Frye and Boosey respectively, depict further examples of drain fittings comprising a threaded top-most member threadedly cooperating with a relatively stationary element to permit relative vertical displacement therebetween.

None of the above prior art devices are seen to suggest the unique combination as offered by the instant invention and wherein a generally conical riser body supports the assembly, transmits applied loads to surrounding fixed material and permits ready elevation of the riser without any excavation of the surrounding material.

SUMMARY OF THE INVENTION

Accordingly, it is an object of the present invention to provide an improved telescopic manhole or storm drain installation including a riser assembly having an inverted conical top portion that minimizes frictional engagement between the riser and the paved surface and permits repositioning in an elevated plane with no excavation being required.

It is another object of the present invention to provide an improved telescopic manhole or storm drain installation including a riser assembly having a tapered upper portion joined to a threaded, vertically disposed lower portion.

A further object of the present invention is to provide an improved telescopic manhole or storm drain installation including a riser assembly having a polygonal upper portion provided with tapered sidewalls and which removably engages a vertically displaceable lower portion threadedly cooperating with a fixed, threaded flange member.

A further object of the present invention is to provide an improved manhole or storm drain installation including a riser assembly having tapered walls joined to a threaded portion and provided with tool-engaging means within the interior bore thereof permitting of ready vertical displacement of the riser assembly.

Another object of the present invention is to provide an improved manhole or storm drain installation including a riser assembly and lid constructed of synthetic composition and provided with cooperating threaded connection means and a labyrinth seal.

Another object of the present invention is to provide an improved manhole or storm drain installation including a riser assembly and removable lid constructed of synthetic polymeric material with the lid base defining a concave configuration providing transmission of imposed loads to the side wall of the riser assembly.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding features throughout the several views of the drawings.

DETAILED DESCRIPTION OF THE PREFERRED EMBODIMENTS

Figure 1:
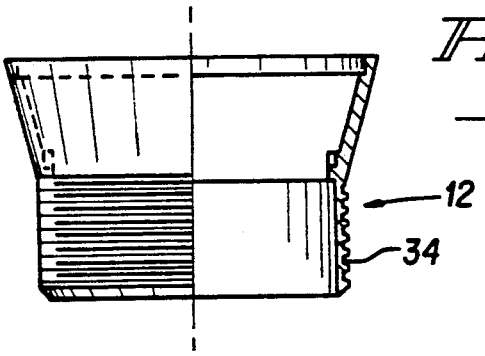
FIG. 1 is a side elevation, partly in section, of one form of riser assembly according to the present invention.
Figure 2:
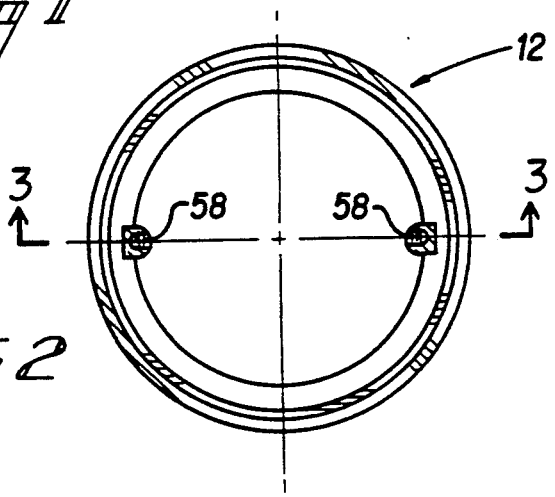
FIG. 2 is a top plan view of the manhole riser shown in FIG. 1.

Referring now to the drawings, particular FIGS. 1-3 and 4, the present invention will be understood to relate to an improved manhole or storm drain installation, generally designated 10 and which includes a riser assembly 12 adapted to cooperate with a stationary collar 14. The riser assembly 12 is provided with a tapered upper section 16 which in this embodiment will be seen to be integral with a lower vertically oriented section 18.

The riser upper section 16 comprises an open ended body having a continuous side wall 20 which is inclined outwardly from its bottom edge 22 to its top edge 24 such that an inverted, frustoconical configuration is defined. This inclination, which is at least 10 degrees from the vertical and preferably 15 degrees or more, provides an important aspect to the invention as will be appreciated hereinafter.

The riser top edge 24 forms a rim adapted to be disposed in a plane which is coplanar with the top surface 26 of the soon to be poured or laid pavement. The majority of the extent of the riser side wall 20 may be of constant thickness as will be seen in FIGS. 1 and 2 while the area adjacent the top edge 24 is relieved adjacent the side wall inner surface 26, to provide a peripheral shelf or ledge 28 adapted to form a seat for the cover or lid 30.

The wall 32 of the riser lower section 18 comprises a circular ring having top and bottom portions **32*a*, 32*b* disposed in a vertical plane and includes external threads 34 preferably throughout its height. It is by this lower section 18 that the entire riser assembly 12 is not only initially supported but also by which subsequent adjustment and support is achieved. These functions are accomplished by means of the stationary collar or ring member 14 which will be understood to be affixed relative any suitable structure, such as the top 36 of the manhole casing 38. This collar 14 may include a base 40 from which vertically projects a circular ring 42 having internal threads 44 thereon providing a close, adjustable fit with the external threads 34 on the riser lower section 18. It is important to appreciate that the purpose of the collar 14** is to enable the adjustment of the riser assembly and not to provide for support of the assembly or accommodate the force of applied traffic loads, as is so often the case in prior known assemblies. These latter functions in the present assembly are absorbed by the conical upper section side wall bearing upon the fixed material surrounding the riser, as will be further described hereinbelow.

Figure 3:
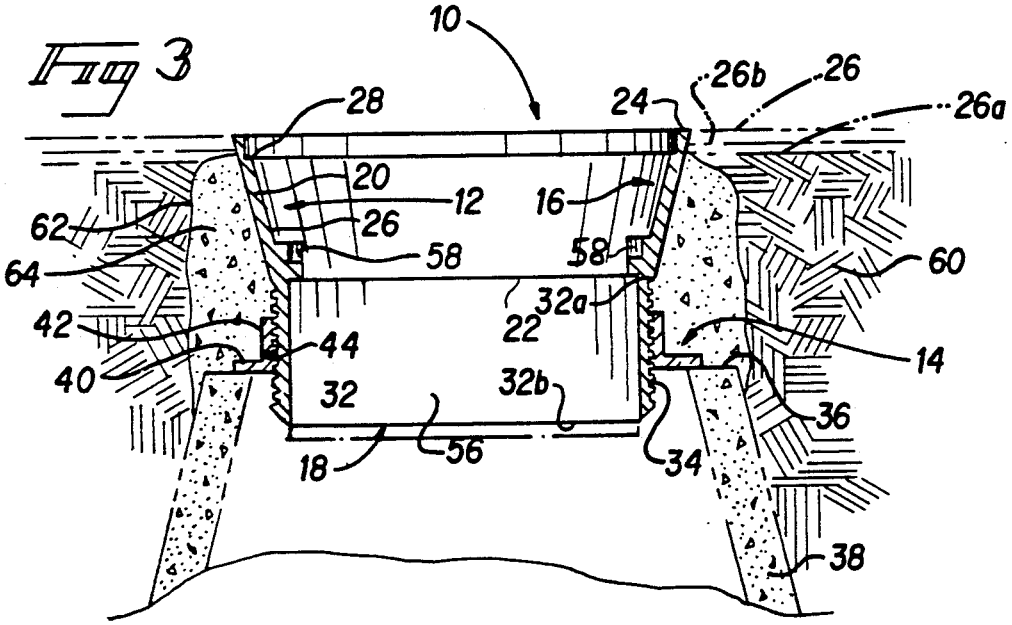
FIG. 3 is a vertical side elevation, taken along the line 3—3 of FIG. 2.

By manipulating the riser assembly 12 to position its top edge 24 at various horizontal planes, a user is able to readily accommodate both an initial road installation as well as a plurality of subsequent resurfacings. FIG. 3 illustrates a complete installation and wherein the top of a roadway base is shown at 26*a*. If the initial finished pavement top surface is to be at the level represented at 26*b*, then the riser assembly 12 is adjusted to position its top edge 24 coplanar therewith. This vertical displacement is achieved merely by rotating the riser upper section 12 relative the stationary collar 14 and is most conveniently carried out by means of a tool such as the tool 46 shown in FIG. 4. This tool comprises a spreader or spanner wrench including a central shaft 48 having a bottom cross-bar 50 with opposite ends 52—52 and a topmost T-handle 54. Manipulation of the riser assembly follows by inserting the tool cross-bar 50 downwardly into the passageway 56 and guiding the two end portions 52—52 in a pair of mating receptors 58—58 comprising upwardly facing sockets fixed relative the riser assembly inner surface 26 adjacent its bottom edge 22. In this manner, the tool engages the riser assembly at diametrically opposed points and intermediate the vertical mass of the assembly such that minimum effort is required to rotate it to position the top edge 24 at the desired final level of the finished pavement.

Following the proper vertical adjustment of the riser assembly 12, any space between the roadway base 60 and the outer perimeter 62 of the riser assembly is filled such as with an appropriate well known non-shrinking, quick-set pourable grouting 64. Thereafter, the paving operation may commence in approximately 20 minutes or less.

If any existing roadway is to be resurfaced, the present assembly requires but 25 minutes or less for one person to adapt the riser assembly 12 and without any power tools or lifting equipment such as hoists or the like. First, the lid 30 is lifted to expose the passageway 56 and the tool 46 inserted into the receptors 58—58. A simple rotary motion upon the tool handle 54 produces a corresponding rotation of the riser assembly 12 and in view of the mating threads 34,44, it is raised accordingly until the top edge 24 is disposed coplanar with the new elevated level of the intended resurfacing material. This displacement is readily accomplished and without any excavation, due to the inclination of the riser upper section 16 since any upward vertical movement thereof results in its outer surface 62 moving away from or parting from, the grouting 64. To further insure the ease by which this adjustment may be made, it will be understood that any suitable environmentally safe lubricant may be applied to the outer surface 62 of the riser assembly during its initial installation. Likewise, such lubricant application preferably is repeated immediately following each subsequent re-adjustment so that grouting 64 as added during each re-adjustment will be discouraged from becoming un-necessarily attached. Subsequent resurfacings are readied for by merely repeating the same procedure, with no more effort or expense than that previously encountered.

Figure 6:
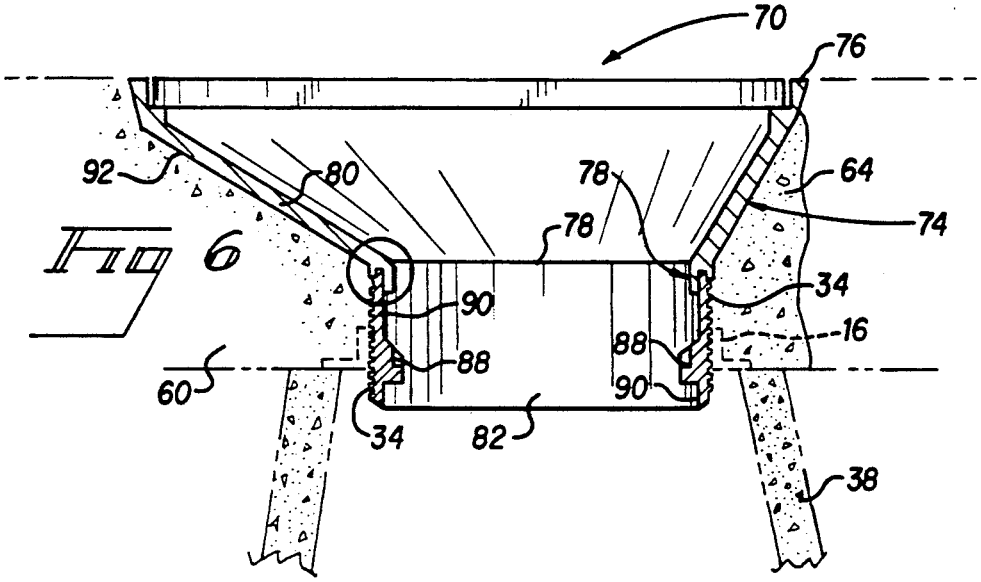
FIG. 6 is a vertical sectional view of another embodiment of the riser assembly, taken along the line 6—6 of FIG. 5.
Figure 7:
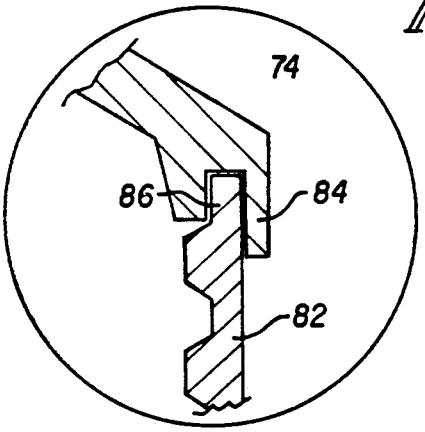
FIG. 7 is a detailed side elevation of the encircled area of FIG. 6.
Figure 8:
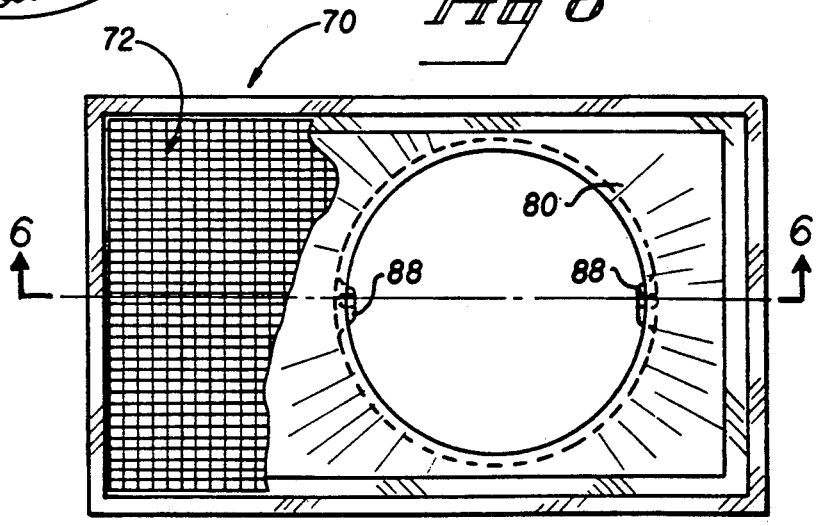
FIG. 8 is a top plan view of the structure of FIG. 6.

The embodiment shown in FIGS. 6–8 follows the same basic principles as that described above but depicts an arrangement modified to accommodate non-circular riser upper portions, such as may be found with perforate manhole or drain installations 70 incorporating a polygonal lid 72 comprising a grating. Such installations often include a manhole casing 38 which is of similar configuration as used with the riser assembly 23 of FIGS. 1–5 since this reduces the extent of excavation and concrete construction which would otherwise be necessary to provide a casing conforming to the enlarged area of the lid or grating 72. Even though the riser assembly upper section 74 includes a square, rectangular or other polygonal configuration in the area of its top edge 76, it will be seen to include a bottom edge 78 that is circular, as in the riser assembly 12. Thus, there still exists an upper riser section 74 which is provided with an upwardly and outwardly inclined or tapered sidewall 80 and accordingly forms an inverted, irregular frustoconical configuration.

With this embodiment, the riser lower section 82 must be a separate member but otherwise will be seen to include the same external threads 34 cooperating with a threaded collar 16, as in the first described variant. In use, the upper and lower riser sections are joined as one assembly by means of mating, sliding connections therebetween. This is provided by the upper section sliding connection comprising a fork arrangement 84 projecting from its bottom edge 78 and which straddles the lower section sliding connection comprising an upstanding rib 86 as shown most clearly in FIG. 7 of the drawings.

The installation and subsequent adjustment of the riser assembly 70 is carried out by the same tool 46 and wherein the ends 52—52 of the cross-bar 50 are inserted into receptors 88–88 now carried by the inner wall 90 of the riser lower section 82 and which are likewise diametrically opposed. With suitable environmentally safe lubricant having been placed upon the outer surface 92 of the riser upper section 74 as well as upon the sliding connections 84,86, it will be appreciated that turning of the engaged tool 46 will produce a rotation of the riser lower section 82 and a concurrent vertical displacement of the riser upper section 74 as the rib 86 freely slides within the fork 84. Again, the inclination of the upper section side wall 80 insures a relatively effortless elevation of the upper section as its displacement is away from and not sliding along with, any juxtaposed roadway base 60 and/or grouting 64.

Figure 9:
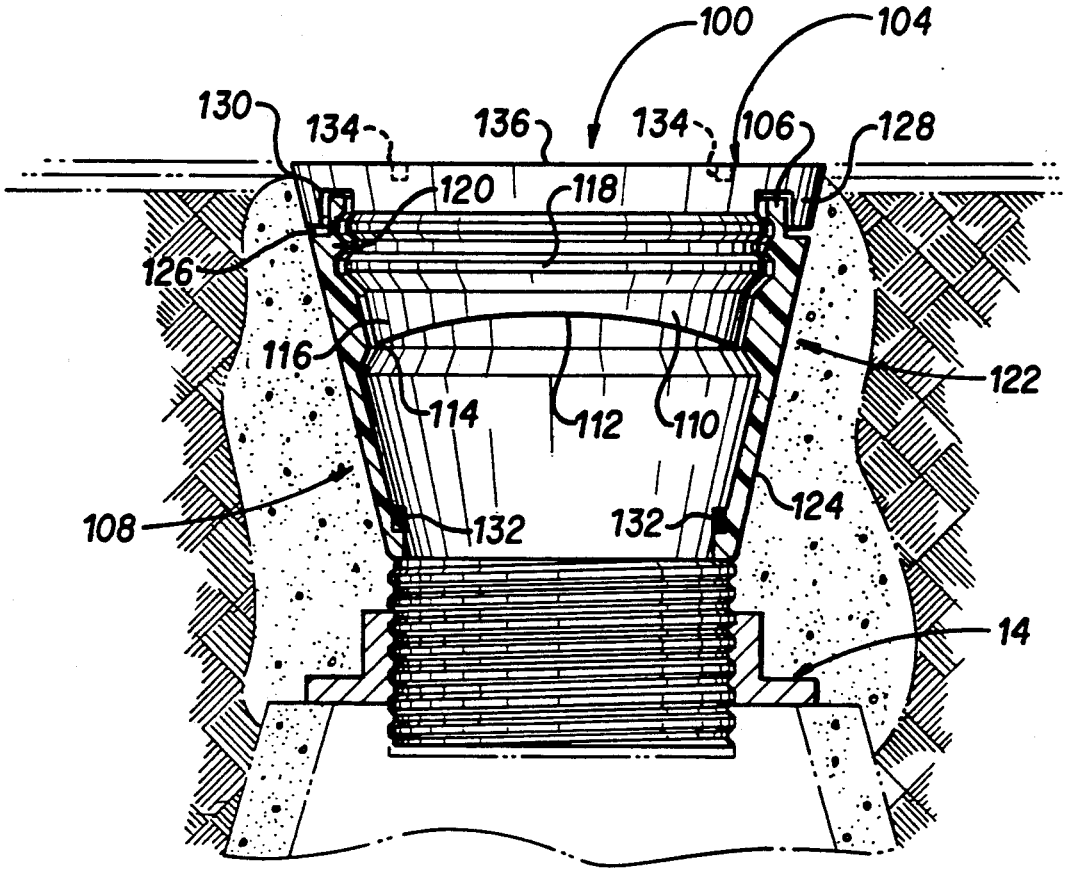
FIG. 9 is a vertical sectional view of an alternative embodiment of the riser assembly.
Figure 10:
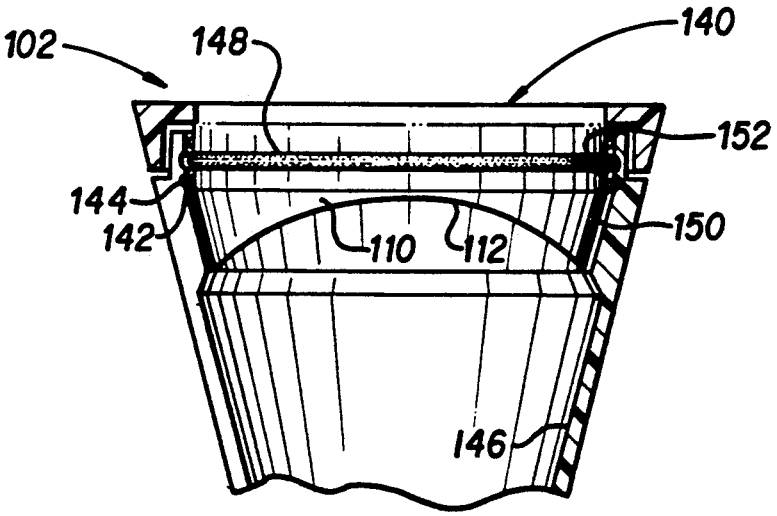
FIG. 10 is a fragmentary vertical sectional view of a further riser assembly embodiment.

Additional embodiments are shown in FIGS. 9 and 10 of the drawings wherein a manhole and storm drain installations 100 and 102 wherein a lid and riser assembly are constructed of synthetic polymeric material. Any of several known compositions exhibit sufficient strength when constructed as described herein, to withstand vehicular loads expected in the present environment. Examples are the polystyrene, methacrylate and polyethylene plastics.

Both installations show the use of a riser assembly which is integral, as in the embodiment of FIGS. 1–4 and 5 and which cooperate with a stationary collar 14 as previously described. Likewise, vertical adjustment is accomplished in the same telescopic manner and by means of the tool 46. The obvious advantage of these latter variants is the substantial reduction in weight. The lid and riser assemblies 100,102 each weights about 75 pounds versus the 350–450 pound weight of a comparable metal assembly 10.

It will be appreciated that the majority of the applied forces which the present devices are subjected to will be vertical compressive forces and obviously the member most affected by this force is the lid. Accordingly, a unique construction and fixation of the lids is proposed in order to accommodate this force. In the embodiment of FIG. 9, the lid 104 is threadedly attached to the top portion 106 of the riser assembly 108. As will be seen, rather than a relatively thin planar member, the lid 104 exhibits a substantial thickness and includes a lower body section 110 having a bottom surface 112 defining a dome or concavity. The peripheral edge 114 of this bottom surface communicates with an unthreaded outer or side wall portion 116 that in turn joins with an externally threaded side wall portion 118. These threads cooperate with internal threads 120 on the upper section 122 of the riser, adjacent its top portion 106. This top portion is inset from the outer surface 124 of the riser to form an exterior recess 126 and which accommodates a downturned lip 128 on the outer periphery of the lid 104, which lip forms a downwardly facing circular groove 130 on the lid.

Figure 4:
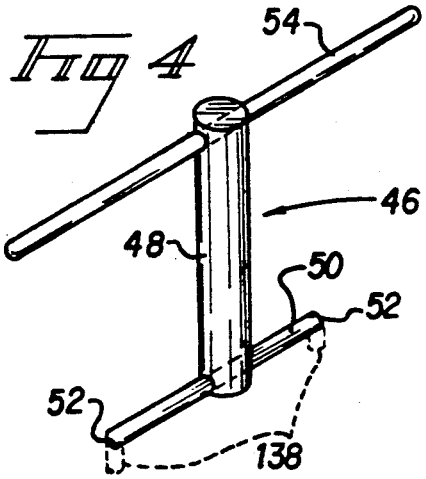
FIG. 4 is a perspective view of an example of a tool usable with the present invention.
Figure 5:
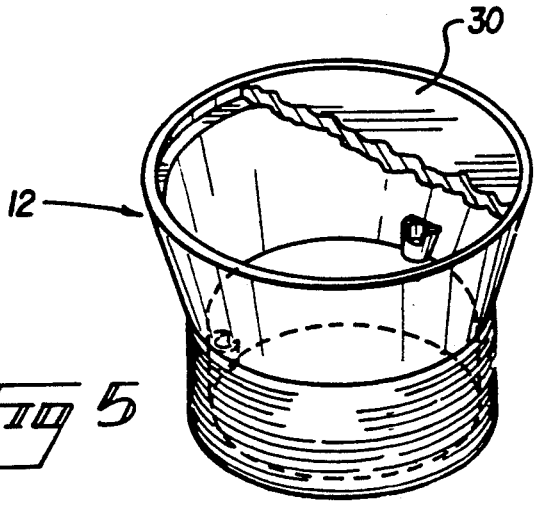
FIG. 5 is a top perspective view of the manhole riser assembly of FIGS. 1-3.

With the above construction in mind it will be understood that rotation of the lid 104 permits its attachment in the use position of FIG. 9 and enables one to remove same for access to the interior of the riser and to affect its vertical displacement by use of the tool 46 within the receptors 132—132. The lid 104 is most readily manipulated by means of a pair of sockets 134—134 in its top surface 136 and which are preferably spaced apart from one another the exact same distance as the two receptors 132—132. With this arrangement, the tool 46 when modified to include a pair of downwardly extending pins 138—138 as shown in FIG. 4 may be used to operate both the lid 104 and the riser assembly 108.

In the variation of FIG. 10, the distinction over that as shown in FIG. 9 is that instead of a threaded connection between the lid 140 and the riser assembly 102, a snap-fit juncture is provided. The same done-shaped lid body 110 is required to obtain the strength and resistance as in the variant of FIG. 9 but instead of the cooperating threads, any suitable snap together retention means is utilized, such as the plurality of lock nubs 142 radially projecting from the lid and which are force fitted within a peripheral groove 144 formed within the inner surface 146 of the riser, an O-ring seal member 148 is carried by the lid outer wall 150 and bears against the riser inner surface 146, which may include a mating groove 152 for receiving the seal member. With this arrangement, a slip type juncture is provided between the lid and riser assembly.

In the case of both embodiments as depicted in FIGS. 9 and 10, the dome-shaped configuration of the lid lower body 110 assists in transmitting downward compressive forces upon the lid top, in a radial outward direction whereupon the greatest height of the lids in the area of their outer walls, is urged into engagement with the riser inner surfaces.

It is to be understood that the present invention is not limited to the sole embodiment described above, but encompasses any and all embodiments within the scope of the following claims.

We claim:

1. A telescopic manhole and storm drain installation including:

a riser assembly having an upper section adjacent a lower section and defining an interior passageway therein, said upper section having a side wall terminating in opposite top and bottom portions, said side wall inclined upwardly and outwardly from said bottom portion to said top portion and defining substantially an inverted frustoconical configuration, said lower section including a circular wall extending in a vertical plane and provided with external threads thereon, a lid removably attachable to said side wall top portion and spanning said interior passageway, mating threads on said lid and riser assembly upper section top portion, a stationary ring member having internal threads thereon, said riser assembly lower section external threads engaging with said ring member internal threads, and a plurality of spaced apart tool-engaging receptors on said riser assembly and projecting into said interior passageway, whereby upon removal of said lid from said riser assembly side wall top portion and insertion of a tool into said receptors, rotation of the tool rotates said riser assembly lower section to elevate said riser assembly lower and upper sections, during which elevation said upper section inclined side wall is moved away from any material previously engaging said upper section inclined side wall.

2. A telescopic manhole and storm drain installation including:

a riser assembly having an upper section adjacent a lower section and defining an interior passageway therein, said upper section having a side wall terminating in opposite top and bottom portions, said side wall inclined upwardly and outwardly from said bottom portion to said top portion and defining substantially an inverted frustoconical configuration, said lower section including a circular wall extending in a vertical plane and provided with external threads thereon, a lid removably attachable to said side wall top portion and spanning said interior passageway, said lid circular in plan view and including a body having upper and lower portions, threads on said body upper portion, said body lower portion having an unthreaded side wall and a downwardly facing dome-shaped concavity whereby, compressive loads applied to said lid are transmitted through said body lower portion to said unthreaded side wall and against said riser assembly upper section side wall, said riser assembly and lid constructed of synthetic polymeric material, a stationary ring member having internal threads thereon, said riser assembly lower section external threads engaging with said ring member internal threads, and a plurality of spaced apart tool-engaging receptors on said riser assembly and projecting into said interior passageway, whereby upon removal of said lid from said riser assembly side wall top portion and insertion of a tool into said receptors, rotation of the tool rotates said riser assembly lower section to elevate said riser assembly lower and upper sections, during which elevation said upper section inclined side wall is moved away from any material previously engaging said upper section inclined side wall.

3. A telescopic manhole and storm drain installation according to claim 2 including, cooperating slip-fitting means on said lid and riser assembly upper sections top portion.

4. A telescopic manhole and storm drain installation according to claim 3 including, O-ring sealing means intermediate said lid and riser assembly top portion.

5. A telescopic manhole and storm drain installation including:

a riser assembly having an upper section adjacent a lower section and defining an interior passageway therein, said upper section having a side wall terminating in opposite top and bottom portions, said side wall inclined upwardly and outwardly from said bottom portion to said top portion and defining substantially an inverted frustoconical configuration, said lower section including a circular wall extending in a vertical plane and provided with external threads thereon, said lower section circular wall having an uppermost portion vertically aligned with and engageable with said upper section side wall bottom portion, a lid removably attachable to said side wall top portion and spanning said interior passageway, a stationary ring member having internal threads thereon, said riser assembly lower section external threads engaging with said ring member internal threads, and a plurality of spaced apart tool-engaging receptors on said riser assembly and projecting into said interior passageway, said receptors located no higher than substantially the medial height of said riser assembly and each defining a vertically disposed cavity accessible from above, along a vertical axis extending therethrough, whereby upon removal of said lid from said riser assembly side wall top portion and insertion of a tool into said receptor cavities, rotation of the tool rotates said riser assembly lower section to elevate said riser assembly lower and upper sections, during which elevation said upper section inclined side wall is moved away from any material previously engaging said upper section inclined side wall.

6. A telescopic manhole and storm drain installation according to claim 5 wherein, said riser assembly upper section top portion is circular in plan view.

7. A telescopic manhole and storm drain installation according to claim 5 wherein, said riser assembly upper section top portion is polygonal in plan view.

8. A telescopic manhole and storm drain installation according to claim 5 wherein, said riser assembly upper and lower sections comprise an integral member.

9. A telescopic manhole and storm drain installation according to claim 5 wherein, said riser assembly upper and lower sections comprise separate members, and mating sliding connection means joining said upper and lower sections together.

10. A telescopic manhole and storm drain installation according to claim 5 wherein, said plurality of receptors include a pair of diametrically opposed receptors.

11. A telescopic manhole and storm drain installation according to claim 5 wherein, said lid comprises a grating.

12. A telescopic manhole and storm drain installation according to claim 9 wherein, said sliding connection means includes an upstanding rib on said lower section and a downwardly facing fork on said upper section.

13. A telescopic manhole and storm drain installation according to claim 5 wherein, said riser assembly upper section side wall is inclined from the vertical an amount greater than 10 degrees.

* * * * *